US005566467A

United States Patent [19]

Hofbauer

[11] Patent Number: 5,566,467

[45] Date of Patent: Oct. 22, 1996

[54] CYCLONE HEAT EXCHANGER

[75] Inventor: Stefan Hofbauer, Schelklingen, Germany

[73] Assignee: Heidelberger Zement Aktiengesellschaft, Heidelberg, Germany

[21] Appl. No.: 389,388

[22] Filed: Feb. 16, 1995

[30] Foreign Application Priority Data

Oct. 7, 1994 [DE] Germany ..... 44 35 871.7

[51] Int. Cl.[6] ..... F26B 21/06

[52] U.S. Cl. ..... 34/79; 34/82; 34/167

[58] Field of Search ..... 34/167, 168, 176, 34/177, 82, 79

[56] References Cited

U.S. PATENT DOCUMENTS 3,419,968 1/1969 Jage ..... 34/168

3,592,453 7/1971 Jager ..... 34/79

*Primary Examiner*—Henry A. Bennett
*Assistant Examiner*—Dimmatia Doster
*Attorney, Agent, or Firm*—Anderson Kill Olick & Oshinsky, P.C.

[57] ABSTRACT

A cyclone heat exchanger including a plurality of arranged one above another cylone separators forming, respectively, a plurality of heat exchange stages, a first inlet for delivering raw meal to the heat exchanger, a first outlet for delivering the heated raw meal from the heat exchanger, a second inlet for delivering a hot gas to the heat exchanger, a second outlet for delivering the cooled gas from the heat exchanger, and at least one motor-driven conveyor device arranged between at least two heat exchange stages, located immediately one above the other, and defined by respective cyclone separators for transporting the raw meal between the stages.

5 Claims, 3 Drawing Sheets

CYCLONE HEAT EXCHANGER

BACKGROUND OF THE INVENTION

The invention relates to a cyclone heat exchanger and, in particular, to a cyclone heat exchanger that serves as a preliminary stage of a dry process-type rotary kiln for burning cement clinker or the like, and that includes a plurality of heat exchange stages formed by cyclone separators arranged one above the other, an inlet for the delivery of raw meal to the heat exchanger, an outlet for delivering the heated raw meal from the heat exchanger to the rotary kiln, another inlet for delivering hot gas from the rotary kiln to the heat exchanger, and another outlet for delivering the cooled gas from the heat exchanger.

The cyclone heat exchangers of this type are well known and are widely used for saving energy during production of clinker in the dry process-type rotary kiln.

Usually, the raw meal which is supplied from a hot-air drying installation, is delivered to the inlet of the heat exchanger, passes through separate stages formed by the cyclone separators and, finally, is delivered from a heat exchanger outlet to the rotary kiln where the actual burning process in hot gas takes place. The raw meal passes through the rotary kiln and is converted into a clinker. At the rotary kiln end, the clinker is cooled down and is transported for further processing or storage.

The hot gas, which is used for burning the raw meal in the kiln, passes from the kiln and through the heat exchanger in a direction opposite to the direction in which the raw meal flows. After being preliminarily heated in a cooler at the kiln end, which serves for cooling the clinker, the heated gas flows through the kiln in a direction opposite to that of the raw meal.

After passing the kiln, the hot gas is blown by a blower through a gas inlet of the heat exchanger thereinto. In the heat exchanger, the still hot gas contacts the raw meal, which is delivered from the drying installation, in several stages. This results in heating of the raw meal and in cooling of the gas.

In each stage of the heat exchanger, the raw meal and the gas are again separated. The separation of the raw meal and the gas takes place in the cyclone separators. By tangential feeding of a raw meal gas mixture into a cyclone separator, centrifugal forces are generated in the separator. The centrifugal forces cause the separation of the raw meal and the gas. The raw meal slides along the funnel-shaped wall of the separator downward, whereas the gas moves through an immersion pipe upward.

To prevent densification, the raw meal is conducted to the below-located stage of the heat exchange through a down pipe. The gas is conducted to the above-located stage through a stand pipe. Because of the elevated temperatures of the raw meal, it is important that the raw meal passes from one stage to another through the down pipe.

As a result, the heat from the gas is transferred to the raw material in separate stages of the heat exchanger as the raw meal passes from the top of the heat exchanger downward. At that, the gas, which is delivered from the uppermost stage of the heat exchanger, e.g., to the hot air drying installation for drying the raw material, still has a temperature of about 300° C. This significantly reduces the heating energy costs during the clinker production.

The above-described cyclone heat exchanger with a plurality of stages formed by the separators arranged one above the other is described in a publication "*Cement-Lime-Gypsum*" (*Zement-Kalk-Gips*", Bauverlag Wiesbaded, Issue 38 (1985), Book 2, p.p. 67–76.

Because of increasing energy prices, a trend has been observed in the latter years to increase the number of separate stages in the above-described cyclone heat exchanger for better utilization of the rotary kiln heat. If a conventional heat exchanger previously had four stages, in the latter years six-stage heat exchangers came into existence.

The height of a six-stage heat exchanger may reach 130 m and this, because of unproportionally rising constructional costs, leads to a sharp increase in investment costs for such a heat exchanger. Local conditions often prohibits construction of heat exchangers of such height, for example, the requirements of landshaft preservation or the necessity to insure the safety of low-level airplane flights.

Also, the requirements of maintaining and/or modernization of heat exchangers with additional stages and/or static problems make it often impossible to construct heat exchangers with additional stages.

Accordingly, an object of the invention is providing a cyclone heat exchanger having a reduced height in comparison with a conventional cyclone heat exchanger while insuring obtaining an adequate heat exchange capability.

SUMMARY OF THE INVENTION

This and other objects of the invention, which will become apparent hereinafter, are achieved by providing at least one motor-driven conveying device between at least two stages arranged one immediately beneath the other.

Providing a motor-driven conveying device between two adjacent stages permits to significantly reduce the height of a multi-stage cyclone heat exchanger because the down-pipes, which were previously required for transporting the raw meal between the stages, can be eliminated. Also, providing a motor-driven conveying device between adjacent stages permits to arrange the adjacent stages closer to each other than it is possible when down-pipes are used. In particular, the present invention permits to provide an existing cyclone heat exchanger with an additional one or even two stages of cyclone separators, without substantially increasing the height of the heat exchanger.

Advantageously, at least one conveying device is arranged between the uppermost stage and the second stage and between second and third stages, or at least one conveying device may be arranged only between the uppermost and second stages.

The modernization of existing heat exchanges can be effected rather easily. Specifically, if providing moderate temperatures of the raw meal in the uppermost stage of the exchanger is useful, the conveying device is provided in the first line of the uppermost stage.

preferably, a troughed chain conveyor is used as a conveying device. The advantages of a troughed chain conveyor consist in that the length of its horizontal track can be adjusted to correspond to local conditions, and that the raw meal transported thereon does not densify, or the densification is very insignificant. A closed troughed chain conveyor can be easily incorporated into a closed system of the cyclone heat exchanger.

Finally, the troughed chain conveyor, if required, with a slight modification, can be used without any problem for transporting hot bulk materials as in the present case, or hot or preheated raw meal.

BRIEF DESCRIPTION OF THE DRAWINGS

The objects and features of the present invention will become more apparent, and the invention itself will be best understood from the following detailed description of the preferred embodiment, when read with reference to the accompanying drawings, wherein.

DETAILED DESCRIPTION OF THE PREFERRED EMBODIMENT

Figure 1:
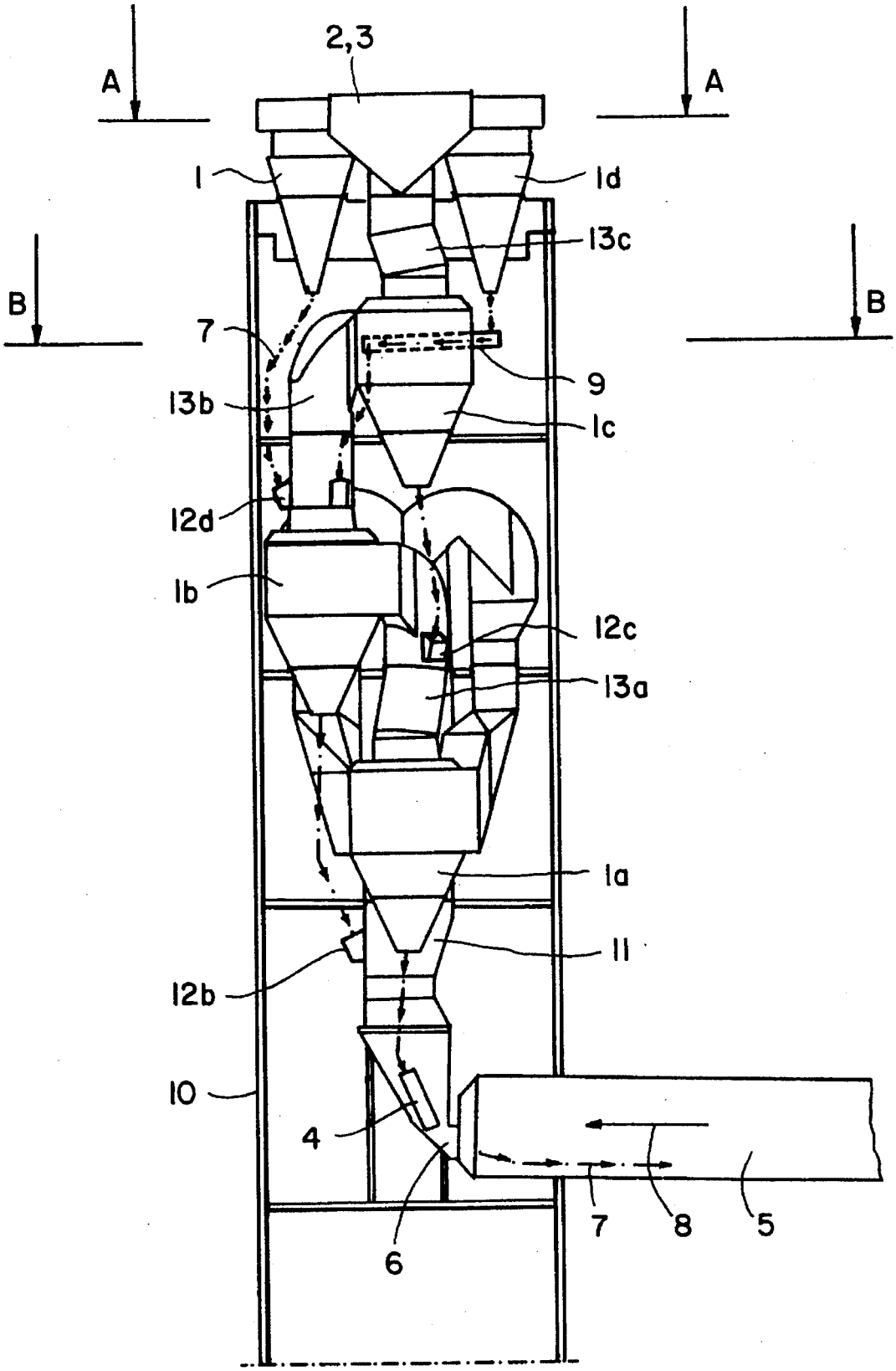
FIG. 1 is a side view of a cyclone heat exchanger according to the present invention.
Figure 2:
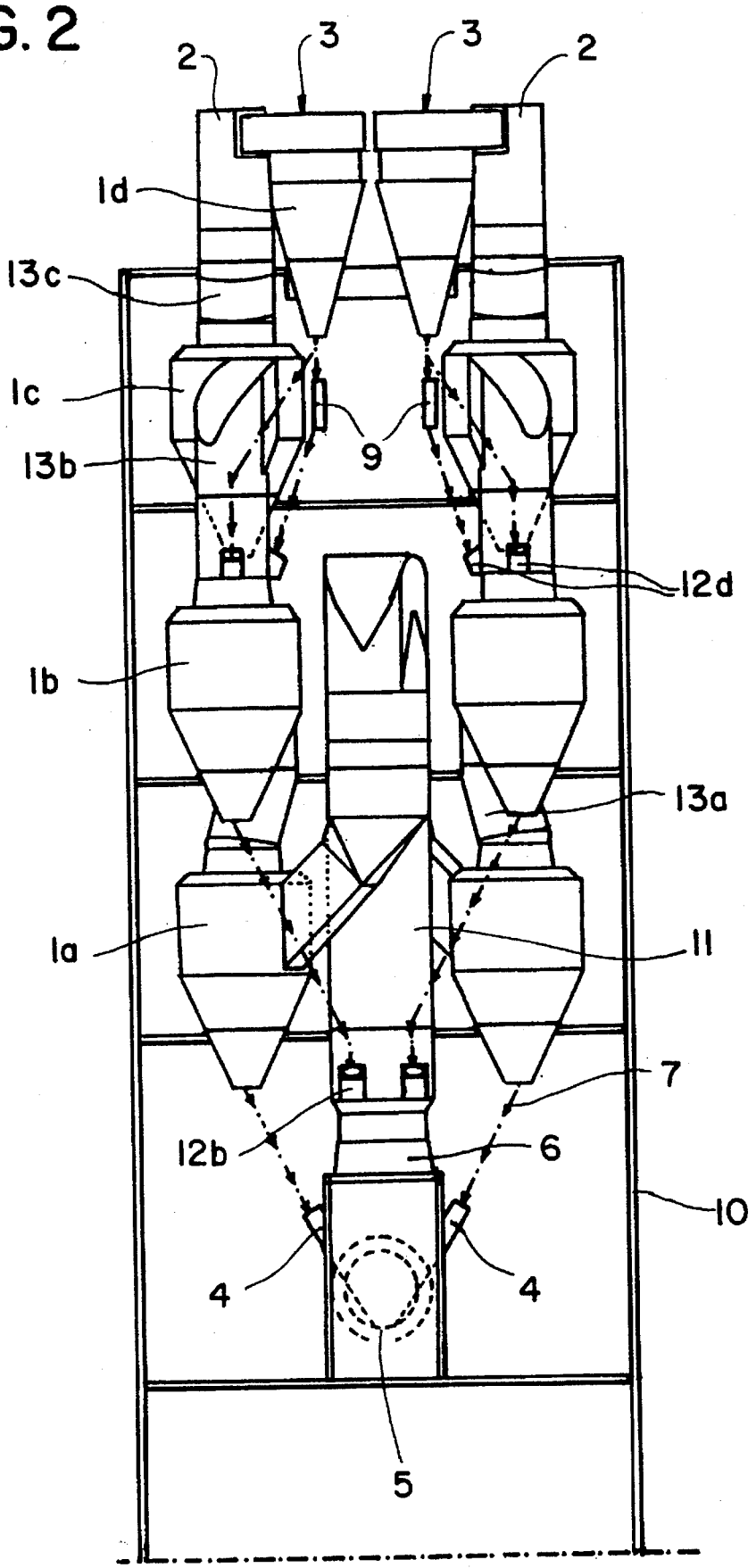
FIG. 2 is a front view of a cyclone heat exchanger according to the present invention.

FIGS. 1 and 2 show side and front views of a cyclone heat exchanger which serves as a preliminary stage of a dry process-type rotary kiln 5. The four heat exchange stages form a tower 10 which is shown in the drawings schematically. The height of the tower 10 is somewhat short of 60 m.

The path of raw meal 7 can be clearly seen in FIGS. 1 and 2. The raw meal 7 is delivered to the cyclone heat exchanger through the inlet 2, which is not shown in detail. The raw meal 7 is mixed with gas 8 coming out of the heat exchanger. The temperatures of the raw meal 7 and the gas 8 are equalized due to heating or cooling in the first stage of the heat exchanger.

The resulting mixture of the suspended material and the gas is then blown tangentially into the cyclone separators 1*d* of the uppermost heat exchange stage, with the raw meal 7 being deposited on the walls of the cyclone separators 1*d*. The raw meal 7 slides along the walls downward and is conducted to mixing openings 12*d* of stand pipes 13*b* through a down-pipe, which is shown only schematically, and through a conveying device 9, provided according to the present invention and which is formed as a troughed chain conveyor.

Through the mixing openings 12*d*, the raw meal 7 is aspirated into the gas flow of the stand pipes 13*b* and intermixes with the upward flowing gas 8. The stand pipes 13*b* form part of a second heat exchange stage of the cyclone heat exchanger. The resulting raw meal gas mixture tangentially flows into the cyclone separators 1*c*, which also forms part of the second heat exchange stage. The gas 8 flows through an immersion pipe into stand pipes 13*c*, and the raw meal 7 flows through a down-pipe, shown only schematically, to mixing openings 12*c*.

Through the mixing openings 12*c*, the raw meal 7 is conducted into the gas stream of the stand pipes 13*a* where it swirls and is further heated. The separation of the raw meal 7 and the gas 8 takes place in the third heat exchange stage formed of cyclone separators 1*b*, with the gas 8 flowing into the stand pipes 13*b* and the raw meal 7 being conducted into mixing openings 12*b*.

Finally, the raw meal 7 flows through the openings 12*b* into a calcinator 11 and therefrom through a stream of gas 8, which flows directly out of the rotary kiln 5 and is, therefore, very hot. Thus, the burning process can take place, at least partially, in the calcinator 11. This permits to provide an extended burning-out path. The strongly heated raw meal 7 is separated from the gas 8 in the lowermost heat exchange stage, defined by cyclone separators 1*a*, and flows to the outlet 4 and therefrom into the rotary kiln 5.

The gas 8 is blown in a direction opposite to the direction of flow of the raw meal 7. From the rotary kiln 5, the gas 8 flows through the calcinator 11 and intermixes with the raw meal 7 in the mixing openings 12*b*, then the gas 8 flows through the cyclone separators 1*a*. From the cyclone separators 1*a*, the gas 8 flows through the stand pipes 13*a* and again intermixes with the raw meal 7. Then, the gas 8 flows into the cylone separators 1*b* and therefrom, through the stand pipes 13*b* into the cyclone separators 1*c*.

Finally, the gas 8 flows through the stand pipes 13*c* and the cyclone separators 1*d*, from which it is directed through the outlet 3 into a hot-air drying installation, not shown, or further away. Thus, in the shown cyclone heat exchanger, the gas 8 intermixes with the raw meal 7 in four stages of the cyclone heat exchanger, so that a very efficient heat exchange between the cooler raw meal and the hotter gas takes place.

The conveying device 9, according to the present invention, permits to equip the uppermost heat exchange stage with four cyclone separators 1*d* without increasing the distance between the cyclone separators 1*c* and 1*d*.

Because the second heat exchange stage contains only two cyclone separators 1*c*, it is possible to provide a wide horizontal path between the cyclone separator 1*d*, shown in the right portion of FIG. 1, and the mixing openings 12*d*, with the available distance between the cyclone separators 1*c* and 1*d*, for transporting the raw meal 7 to the down-pipes.

Because of a large number of the cylone separators 1*d* and the use of the conveying devices 9, a further energy saving becomes possible without a need to increase the height of the tower 10.

Figure 3:
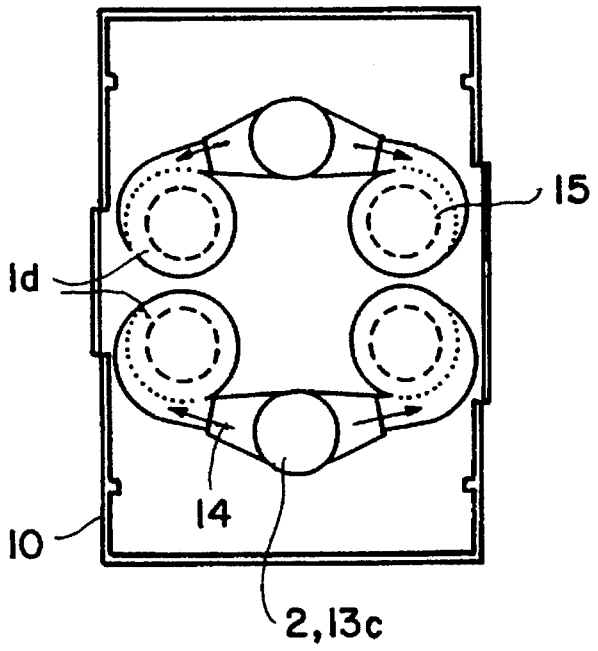
FIG. 3 is a view along line A—A in FIG. 1.

FIG. 3, which represents a view taken along line A—A in FIG. 1, permits to explain the functioning of the cyclone separators 1*d*. The gas 8 flows into the cylone separators 1*d* through the stand pipes 13*c* where it mixes with the raw meal 7 delivered through the inlet conduits 2. The raw meal gas mixture 14 is tangentially blown into the cyclone separators 1*d*.

In the cyclone separators 1*d*, the heated raw meal is deposited on the walls of the cyclone separators 1*d* and slides along them downward. Meanwhile, the gas 8 flows upward through the immersion pipe 15, which is shown schematically.

Figure 4:
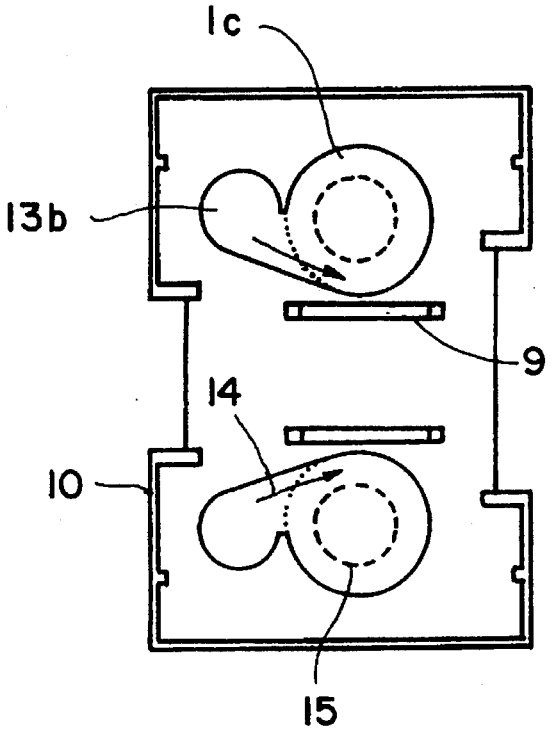
FIG. 4 is a view along line B—B in FIG. 1.

FIG. 4, which represents a view taken along line B—B in FIG. 1, shows the two cyclone separators 1*c*, which define the second heat exchange stage. As in the first or uppermost heat exchange stage, the suspended material gas mixture 14, which flows out of the stand pipes 13*b*, is tangentially delivered into the cyclone separators 1*c*. In the cyclone separators 1*c*, as in the cyclone separators 1*d*, the raw meal 7 is separated from the gas 8 with the gas 8 flowing through the immersion pipe 15 to the stand pipe 13*c* (not shown in FIG. 4).

As it follows from the foregoing description of the inventive cyclone heat exchanger, the cyclone heat exchanger according to the present invention permits to significantly reduce the height of the heat exchanger tower or, where the existing cyclone heat exchangers are involved, to provide for an increased energy saving without a need to increase their height.

This is especially important in view of the present trend to increase the number of heat exchange stages to save energy.

Though the present invention was shown and described with reference to a preferred embodiment, various modifications thereof will become apparent to those skilled in the art and, therefore, it is not intended that the invention be limited to the disclosed embodiment and/or details thereof, and departures may be made therefrom within the spirit and scope of the appended claims.

What is claimed is:

1. A cyclone heat exchanger, comprising:

a plurality of arranged one above another cyclone separators defining, respectively, a plurality of heat exchange stages;

a first inlet for delivering raw meal to said heat exchanger;

a first outlet for delivering the heated raw meal from said heat exchanger;

a second inlet for delivering a hot gas to said heat exchanger;

a second outlet for delivering the cooled gas from the heat exchanger; and at least one motor-driven conveyor device arranged between two heat exchange stages, located immediately one above the other and defined by respective cyclone separators, for transporting the raw meal from an upper heat exchange stage to a lower heat exchange stage.

2. A cyclone heat exchanger, comprising:

a plurality of arranged one above another cyclone separators defining, respectively, a plurality of heat exchange states;

a first inlet for delivering raw meal to said heat exchanger;

a first outlet for delivering the heated raw meal from said heat exchanger;

a second inlet for delivering a hot gas to said heat exchanger;

a second outlet for delivering the cooled gas from the heat exchanger; and at least one motor-driven conveyor device arranged between at least two heat exchange stages, located immediately one above the other and defined by respective cyclone separators, for transporting the raw meal, wherein said at least one conveying device is arranged between an uppermost heat exchange stage and a second stage, and at least one conveying device is arranged between the second stage and a third stage.

3. A cyclone heat exchanger as set forth in claim 2, wherein said conveying devices comprise a troughed chain conveyor.

4. A cyclone heat exchanger, comprising:

a plurality of arranged one above another cyclone separators defining, respectively, a plurality of heat exchange stages;

a first inlet for delivering raw meal to said heat exchanger;

a first outlet for delivering the heated raw meal from said heat exchanger;

a second inlet for delivering a hot gas to said heat exchanger;

a second outlet for delivering the cooled gas from the heat exchanger; and at least one motor-driven conveyor device arranged between at least two heat exchange stages, located immediately one above the other and defined by respective cyclone separators, for transporting the raw meal, wherein said at least one conveying device is arranged between the uppermost heat exchange stage and a second stage.

5. A cyclone heat exchanger as set forth in claim 4, wherein said at least one conveying device comprises a troughed chain conveyor.

* * * * *